US005863230A

United States Patent [19]

Morrison

[11] Patent Number: 5,863,230

[45] Date of Patent: Jan. 26, 1999

[54] UNIVERSAL MARINE DRIVE APPARATUS AND USES THEREOF

[76] Inventor: Douglas M. Morrison, Box 733-A, Hwy. 304, Thibodaux, La. 70301

[21] Appl. No.: 721,354

[22] Filed: Sep. 26, 1996

[51] Int. Cl.[6] ..... B63H 5/125

[52] U.S. Cl. ..... 440/61; 440/50; 440/88; 416/163

[58] Field of Search ..... 440/50, 51, 66, 440/71, 88; 416/163

[56] References Cited

U.S. PATENT DOCUMENTS

| | | | |
|---|---|---|---|
| 2,356,844 | 8/1944 | Higgins | 257/124 |
| 2,387,700 | 10/1945 | Cribb . | |
| 2,415,183 | 2/1947 | Law | 440/66 |
| 2,850,106 | 9/1958 | Swan | 416/163 |
| 2,939,334 | 6/1960 | Beckjord | 416/167 |
| 3,561,524 | 2/1971 | Satterthwaite | 165/76 |
| 3,650,310 | 3/1972 | Childress | 165/44 |
| 3,841,396 | 10/1974 | Knaebel et al. | 165/44 |
| 3,933,116 | 1/1976 | Adams et al. . | |
| 3,976,027 | 8/1976 | Jones, Sr. | 440/61 |
| 4,040,476 | 8/1977 | Telle et al. | 165/76 |
| 4,043,289 | 8/1977 | Walter . | |
| 4,360,350 | 11/1982 | Grover | 440/88 |
| 4,544,362 | 10/1985 | Arneson | 440/61 |
| 4,557,319 | 12/1985 | Arnold | 165/44 |
| 4,565,175 | 1/1986 | Kaye | 123/542 |
| 4,616,588 | 10/1986 | Caddick | 114/162 |
| 4,645,463 | 2/1987 | Arneson | 440/57 |
| 4,654,013 | 3/1987 | Bland et al. | 440/57 |
| 4,674,984 | 6/1987 | Caddick | 440/88 |
| 4,738,644 | 4/1988 | Happel | 440/66 |
| 4,790,782 | 12/1988 | McCormick | 440/61 |
| 4,846,741 | 7/1989 | Betsinger | 440/57 |
| 4,976,638 | 12/1990 | Grinde | 440/57 |
| 5,017,090 | 5/1991 | Morrison | 416/168 R |
| 5,102,301 | 4/1992 | Morrison | 416/163 |
| 5,104,291 | 4/1992 | Morrison | 416/168 R |
| 5,226,844 | 7/1993 | Muller | 440/50 |

*Primary Examiner*—Jesus D. Sotelo
*Attorney, Agent, or Firm*—John F. Sieberth; R. Andrew Patty, II

[57] ABSTRACT

Described is novel apparatus for rendering a watercraft propulsion system universal. One embodiment of the invention comprises a rotary shaft; a propeller detachably attached to one end of the rotary shaft, the other end of the rotary shaft being configured for detachable and either direct or indirect connection to, and rotational relationship with, a drive shaft of the engine; a plate which is directly or indirectly pivotally attached to a stern portion of the watercraft and which, during normal operation, is disposed in a substantially horizontal plane above the propeller, the plane of the plate traversing the rotary shaft; and a hollow heat-conductive loop integral with or connected to the apparatus and connected to the cooling system for circulating a flow of the fluid from the cooling system through the loop and thence back to the cooling system, the loop being adapted to be disposed in thermally-conductive heat exchange contact with the water when the watercraft is being propelled by the engine. Preferably, during normal operation, the plate is substantially disposed in a plane parallel with, but no lower than, the bottom of the watercraft. The apparatus may be detachably and pivotally attached to the stern of the watercraft at a front side of the apparatus opposite the propeller, and may be adapted to permit vertical and lateral control of a rear side of the apparatus proximate to the propeller by an operator of the watercraft. Complete universal propulsion systems and universal watercraft apparatus are also described.

46 Claims, 14 Drawing Sheets

UNIVERSAL MARINE DRIVE APPARATUS AND USES THEREOF

TECHNICAL FIELD

This invention relates to watercraft drive or propulsion apparatus which employ an internal combustion engine and are particularly adapted to be universal. It will be understood that the term "universal" as used in this specification, the abstract, and the appended claims to describe a propulsion system, propulsion apparatus, or watercraft shall mean operative under either deep or shallow water conditions, and operative in water which may be either free of floating debris, or full of suspended vegetation or other debris. Likewise, it will be understood that the term "universally" as used in this specification and the appended claims shall mean to do so under either deep or shallow water conditions, and in water which may be either free of floating debris, or full of suspended vegetation or other debris.

BACKGROUND

Propulsion systems powered by internal combustion engines are commonly used on boats and other watercraft. Typically, these systems have been designed for use either in deep water conditions or shallow water conditions, but not both. Most often, such propulsion systems are not adapted for conditions in which floating debris is suspended in the surrounding water. Regardless of the type of use which is intended, many of these systems employ a power source which is connected to a drive shaft which, in turn, is connected to a propeller in physical contact with the water. Variations of this typical configuration include, for example, systems which employ forced water (i.e., water jet propulsion) or forced air (i.e., air propulsion) without the use of a propeller in physical contact with the water. As one might expect, different advantages are presented by the various system configurations. A principal means of assessing a particular propulsion system is its versatility in varying water conditions. For example, deep, clean bodies of water present different operating conditions for a propulsion system as compared to bodies of water which are partially or substantially shallow, or bodies of water in which vegetation or other debris may be suspended. Systems which employ a fixed propeller which cannot be removed from the water during operation are not compatible with use in shallow waters, since the probabilities of watercraft grounding and/or damage to the propeller are greater. Those which employ water jet propulsion are also vulnerable under such conditions or in conditions where vegetation or other debris is suspended in the water, since these systems typically require a water intake port which can become clogged in such circumstances, thereby causing the system to fail. Even air boats or other craft which are propelled by large rotating fans powered by internal combustion engines present disadvantages for the user because of, for example, increased noise, excessive size (as it affects space available on the watercraft), increased danger (due to the large rotating blades), and significant limitations on reversing the direction of propulsion. Moreover, such air boat configurations typically are not stable enough for proper functioning in deep water conditions.

Regardless of the propulsion system, the internal combustion engine component generates significant heat during operation, and such heat in large part must be transferred away for the engine to perform properly. In marine applications, including both fresh, salt and brackish water conditions, such engines commonly are engineered to include a cooling system which circulates water from outside the watercraft through the engine block to transfer heat away from the engine. Such cooling systems are often referred to as open cooling systems, since these systems permit the inflow of a heat-conductive fluid from an external source, and the outflow of the heated fluid from the system without any recirculation. This is contrasted with closed cooling systems which recirculate a heat-conductive fluid through the engine into an accompanying radiator or other apparatus which transfers heat from the fluid to the surrounding air. Open cooling systems have been preferred in marine applications because of limitations posed by closed cooling systems that require a significant influx of air for heat transfer purposes. Such systems are typically avoided in marine applications in favor of the open cooling systems because of the requirement in closed systems of loud cooling fans or the like to provide air for cooling.

However, a major disadvantage of open cooling systems in internal combustion engines for marine applications is highlighted when the water being traversed is shallow and/or filled with vegetation or other floating debris. Under such circumstances, the inflow of fresh water to the open cooling system or the outflow of heated water from the open cooling system can be significantly impaired when mud, silt, sand, or other debris clogs the system's water flow path. Engine overheating is often the result because the cooling system becomes inoperative as the flow of fresh water through the system is impaired. Additionally, when the water being traversed is salt water or brackish water, corrosion of the various component parts of the cooling system becomes a legitimate concern.

Hence, a need exists for a universal watercraft propulsion system employing an internal combustion engine which enjoys the advantages of open cooling systems in internal combustion engines for marine applications in deep water conditions, while avoiding the disadvantages of such open cooling systems when applied in waters which are shallow and/or filled with vegetation or other floating debris.

In addition, notwithstanding recent advances in reversible pitch propeller technology, propulsion systems employing reversible pitch propellers heretofore have failed to effectively control water flow around the propeller in both forward and reverse pitch settings, especially during application of moderate to high system throttle. Thus, a need also exists for a universal propulsion system which employs, in a highly effective manner, weedless and reversible pitch propeller technology. This need is especially evident in shallow waters, where effective reversive thrust is imperative for maneuvering watercraft around and over sand bars, tree stumps, thick patches of floating vegetation, and the like.

SUMMARY OF THE INVENTION

The present invention is deemed to fulfill these needs by providing, among other things, apparatus for rendering a watercraft propulsion system universal. The propulsion systems adapted by this apparatus are those propulsion systems which are powered by an internal combustion engine having a cooling system through which a heat-conductive fluid flows. The apparatus comprises a) a rotary shaft;

b) a propeller detachably attached to one end of the rotary shaft, the other end of the rotary shaft being configured for detachable and either direct or indirect connection to, and rotational relationship with, a drive shaft of the engine;

c) a plate which is directly or indirectly pivotally attached to a stern portion of the watercraft and which, during normal operation, is disposed in a substantially horizontal plane above the propeller, the plane of the plate traversing the rotary shaft; and d) a hollow heat-conductive loop integral with or connected to the apparatus and connected to the cooling system for circulating a flow of the fluid from the cooling system through the loop and thence back to the cooling system, the loop being adapted to be disposed in thermally-conductive heat exchange contact with the water when the watercraft is being propelled by the engine.

In a preferred embodiment, the apparatus comprises a front side remote from the propeller and a rear side closer to the propeller than the front side, the loop is disposed within the plate of the apparatus, and the plate is substantially disposed in a plane parallel with, but no lower than, the bottom of the watercraft. Additionally, the apparatus is detachably and pivotally attached to the stern portion of the watercraft at the front side of the apparatus, and is adapted to permit vertical and lateral control of the rear side of the apparatus by a watercraft operator.

In another preferred embodiment of this invention, the propeller further comprises (a) a hub from which extends a plurality of blades having an adjustable pitch, the hub having a plurality of arcuate grooves, each of the grooves cooperating respectively with one of the blades so that, notwithstanding a change in the pitch of the blades, the propeller is capable of cutting through and efficiently operating amongst floating vegetation and other fleshy debris suspended in the water, and (b) adjustment means for controllably adjusting the pitch. The adjustment means preferably comprises a pitch-adjusting shaft detachably and either directly or indirectly connected to the other end of the pitch-adjusting shaft for axially moving the pitch-adjusting shaft and thereby controllably reversing the pitch. Reference is made to Applicant's U.S. Pat. Nos. 5,017,090, 5,102,301, and 5,104,291 for further disclosure of the configuration of this preferred propeller.

In another preferred embodiment, the apparatus is detachably and pivotally attached, at its front side, to the stern portion of the watercraft by a dual pivot coupling, the coupling being pivotally attached to the apparatus and the watercraft so as to permit lateral and vertical movement of the rear side of the apparatus and the propeller relative to the stern portion of the watercraft. As is understood by one skilled in the art, the propeller has a front proximate to the stern of the watercraft, a rear remote from the stern of the watercraft, and lateral ends defined by the ends of the rotating propeller blades. In an apparatus of this invention, it is also preferred that the plate extend laterally beyond the lateral ends of the propeller and longitudinally from the stern portion of the watercraft to beyond the rear of the propeller, the plate having at each of its lateral sides a downwardly projecting flange extending along a substantial portion of the plate fore and aft of the propeller.

This invention also provides universal propulsion apparatus which comprises (a) a power portion which comprises an internal combustion engine attached to the watercraft, the engine having a cooling system through which a heat-conductive fluid flows, and (b) a drive portion which comprises a rotary shaft, a propeller in accordance with other embodiments of this invention, a plate and a loop in accordance with other embodiments of this invention, and a front side remote from the propeller and a rear side closer to the propeller than the front side, the drive portion being detachably and pivotally attached to a stern portion of the watercraft at the front side of the drive portion and adapted to permit vertical and lateral control of the rear side of the drive portion by a watercraft operator.

In addition, this invention provides universal watercraft apparatus. The watercraft apparatus comprises a boat hull which has connected thereto a propulsion drive apparatus, the propulsion drive apparatus comprising a propulsion apparatus in accordance with this invention.

A method of universally propelling a watercraft is provided by this invention. The method comprises equipping the watercraft with propulsion apparatus of this invention, and operating the propulsion apparatus to provide controllable thrust to the watercraft.

Furthermore, this invention provides apparatus for controllably adjusting the pitch of propeller blades on an adjustable pitch propeller, the propeller being attached to a hollow rotary shaft. The apparatus comprises:

a) a pitch-adjusting shift shaft disposed within the rotary shaft and having a first end and a second end, the pitch-adjusting shaft being directly or indirectly connected at the first end to the propeller blades;

b) a bearing housing surrounding the rotary shaft and containing a stationary portion and a rotary portion, the rotary portion being rotatable relative to the stationary portion and the housing;

c) at least one connector for detachably attaching the pitch-adjusting shaft to the rotary portion; and d) at least position-shifting mechanism connected to the bearing housing for moving the bearing housing along the rotational axis of the rotary shaft;

whereby, upon movement of the bearing housing along the rotational axis of the rotary shaft, the pitch-adjusting shaft moves along its own longitudinal axis to thereby controllably adjust the pitch of the propeller blades. This apparatus is particularly useful when used in conjunction with the other apparatus of this invention. In a preferred embodiment, the position-shifting mechanism is at least one hydraulic mechanism. It is particularly preferred that the hydraulic mechanism comprises a hydraulic ram radially disposed from the bearing housing, an arm rotatably connected to the bearing housing and the hydraulic ram and having a fulcrum, whereby linear force produced by the hydraulic ram may be inverted and transferred to the bearing housing upon rotation of the arm about the fulcrum. In another preferred embodiment, the connector comprises (i) a cylindrical slide configured to be detachably attached to the second end opposite the propeller, and (ii) a pin which extends through the rotary portion, through the cylindrical slide, and through two elongate apertures in the rotary shaft which are opposite one another and extend in parallel fashion along the rotational axis of the rotary shaft.

This invention provides universal propulsion apparatus for propelling a watercraft, the apparatus comprising (a) a power portion as described above; and (b) a drive portion which comprises:

1) a rotary shaft;

2) a propeller detachably attached to one end of the rotary shaft, the other end of the rotary shaft being configured for detachable and either direct or indirect connection to, and rotational relationship with, a drive shaft of the engine;

3) a cavitation plate which, during normal operations, is disposed in a substantially horizontal plane above the propeller and around the rotary shaft;

4) a supplemental plate extending between the cavitation plate and the transom of the watercraft in a substantially horizontal plane at or near the bottom of the watercraft; and 5) a front side remote from the propeller and a rear side closer to the propeller than the front side;

the drive portion being detachably and pivotally attached to a stern portion of the watercraft at the front side of the drive portion and adapted to permit vertical and lateral control of the rear side of the drive portion by a watercraft operator. Preferably, apparatus of this invention further comprises at least one hydraulic trim ram connecting an upper portion of the apparatus to the stern portion of the watercraft, thereby enabling control of the vertical position of the rear side of the apparatus, and further comprises a release mechanism connected to or integral with the trim ram, the release mechanism being activated upon application of a predetermined level of upward force to the apparatus. It is particularly preferred that the release mechanism comprises a bar pivotally connected to the trim ram at a joint, and one or more spring-loaded latches connected to the apparatus and cooperating with the joint to hold the trim ram in place during normal operation unless the predetermined level of upward force is applied to the apparatus.

This invention additionally provides a watercraft propulsion system comprising a reversible pitch propeller and a cavitation plate disposed above the propeller, the cavitation plate extending laterally beyond the lateral ends of the propeller and longitudinally from a stern portion of the watercraft to beyond the rear of the propeller, the plate having at each of its lateral sides a downwardly projecting flange extending along a substantial portion of the plate fore and aft of the propeller.

These and other embodiments and features of the invention will become still further apparent from the ensuing description, accompanying drawings and appended claims.

BRIEF DESCRIPTION OF THE DRAWINGS

In the Figures, like numerals and/or letters represent like parts among the different Figures.

FURTHER DETAILED DESCRIPTION

As discussed above, this invention provides, among other things, a universal watercraft propulsion system employing an internal combustion engine which enjoys the advantages of open cooling systems in internal combustion engines for marine applications in deep water conditions, while at the same time is adapted for use in waters which may be shallow and/or filled with vegetation or other floating debris. These advantages are incorporated into a propulsion system which also employs reversible pitch propeller technology in a highly effective manner. These advantages and combinations of new features give devices of this invention a very high level of versatility, enabling their use in a variety of water conditions including, but not limited to, shallow waters which are clogged with vegetation or other floating debris.

Figure 1:
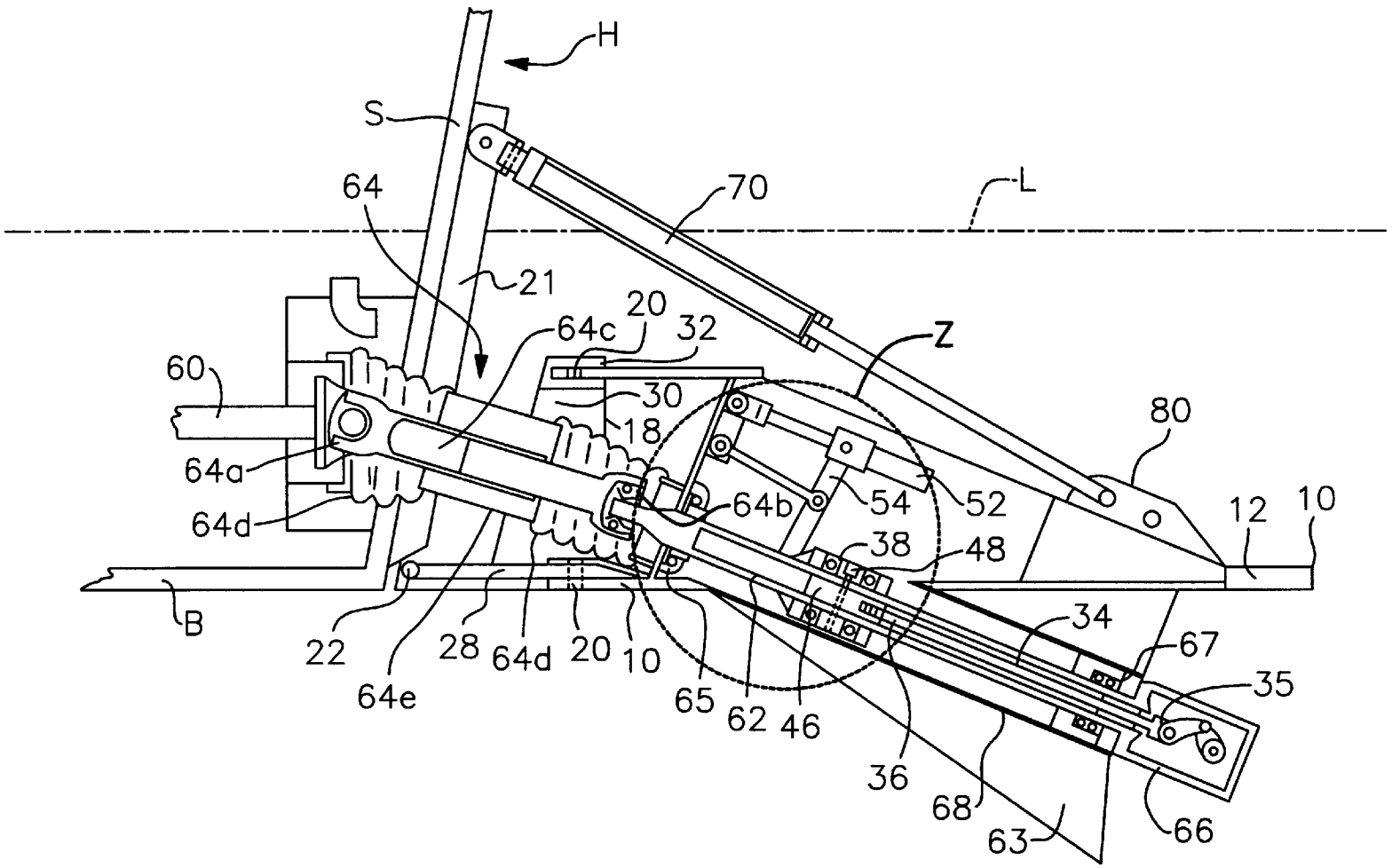
FIG. 1 is a cross-sectional view of a preferred embodiment of this invention partially broken away.
Figure 2:
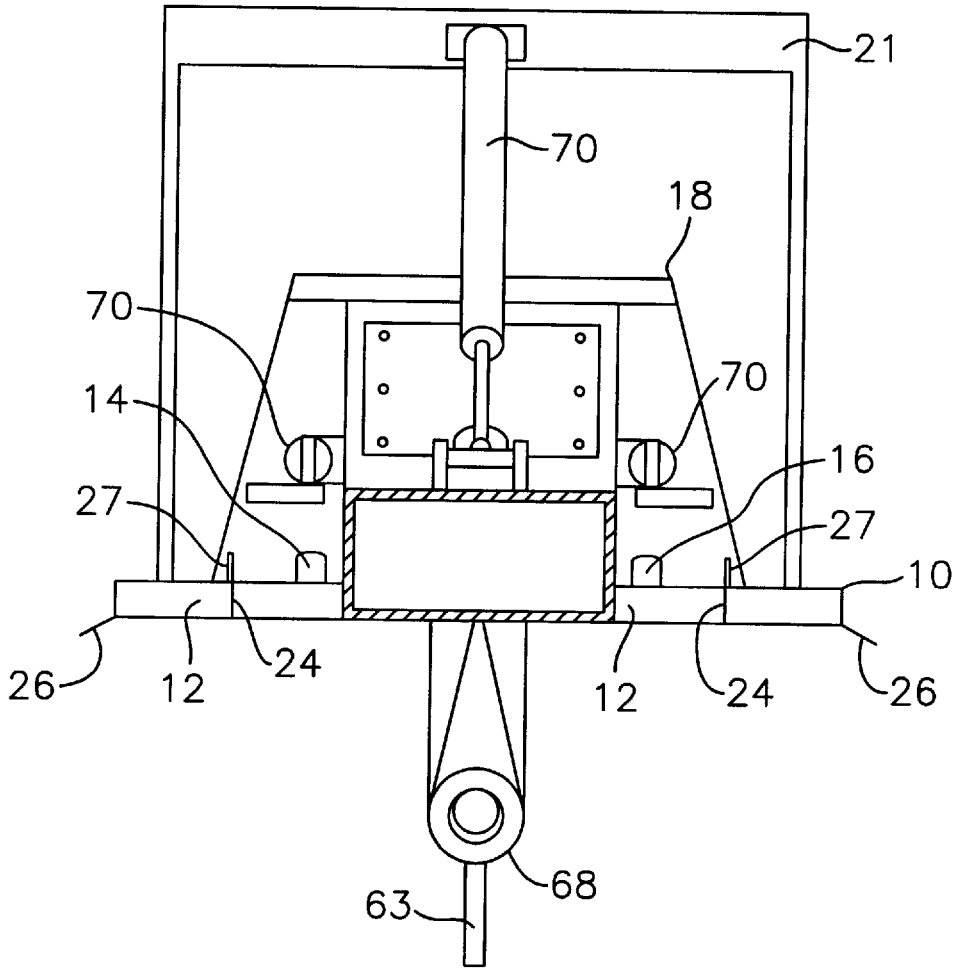
FIG. 2 is a cross-sectional view of the device of FIG. 1 perpendicular to the view illustrated in FIG. 1.
Figure 3:
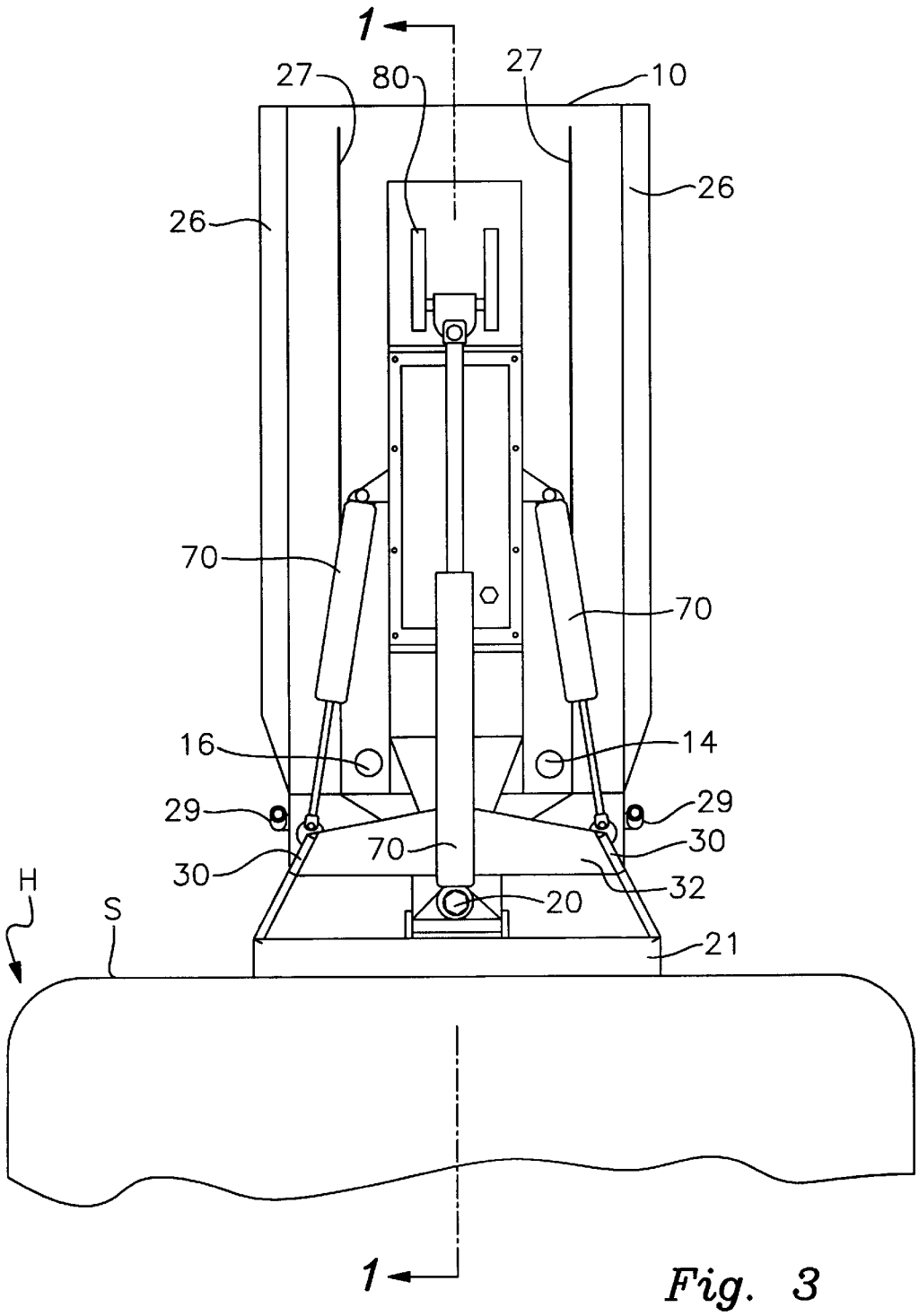
FIG. 3 is a top plan view of the device of FIG. 1 partially broken away.
Figure 5:
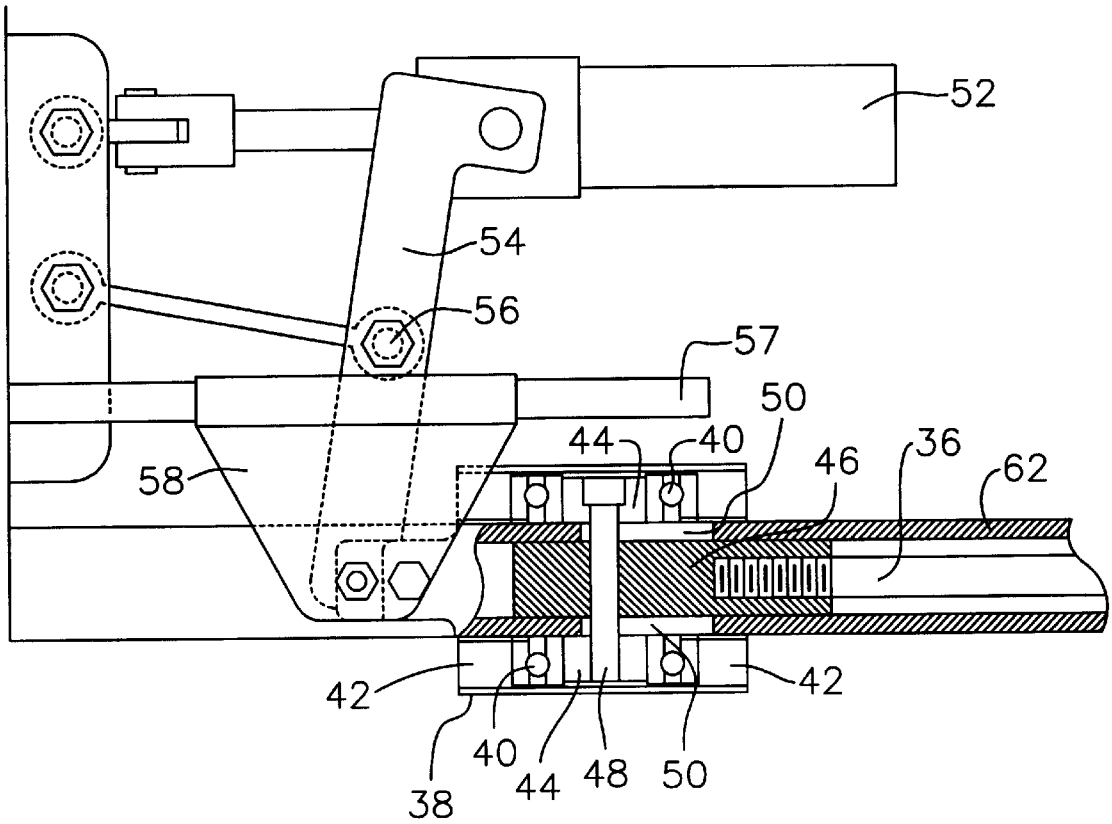
FIG. 5 is an enlarged view of components within broken circle Z illustrated in FIG. 1 showing, among other things, the bearing housing and related components in a forward position.
Figure 6:
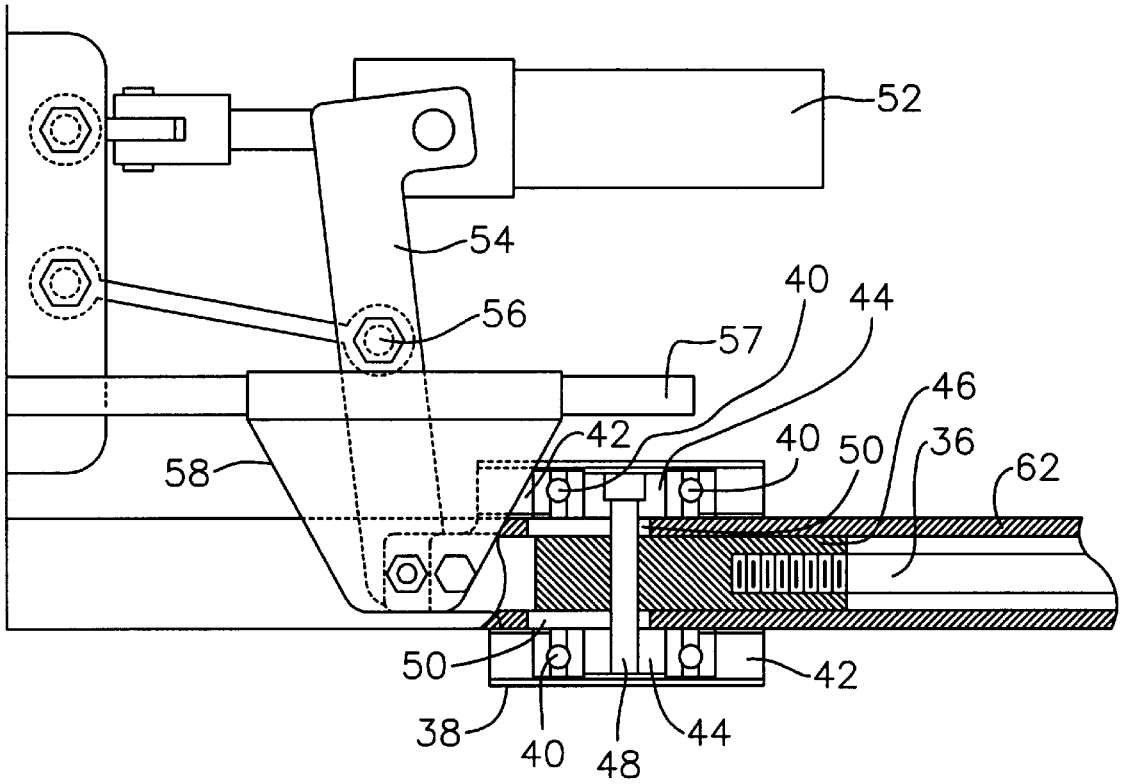
FIG. 6 is an enlarged view of components within broken circle Z illustrated in FIG. 1 showing, among other things, the bearing housing and related components in a rearward position.
Figure 7:
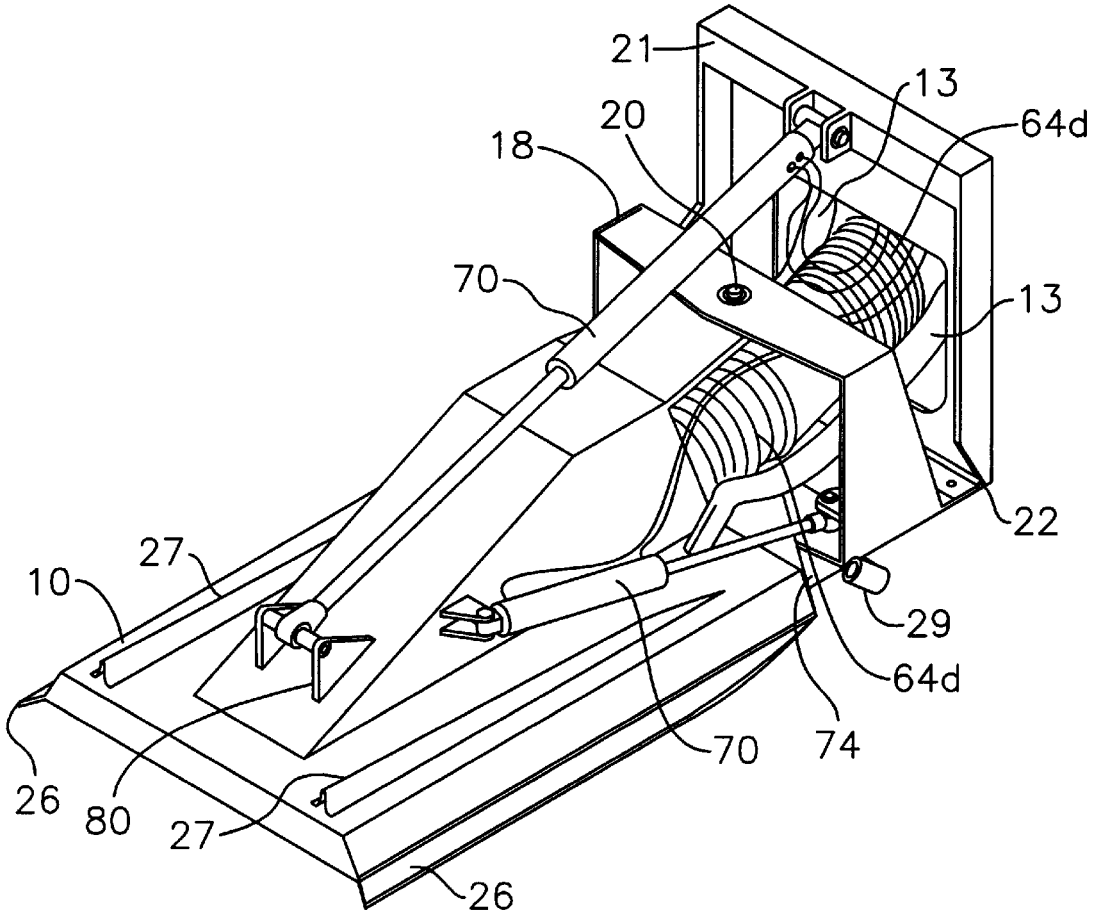
FIG. 7 is a view in perspective of the device of FIG. 1.

Referring now to the drawings, FIGS. 1 through 7 illustrate a preferred embodiment of this invention. This particular embodiment is apparatus for adapting a watercraft propulsion system to be universal. The propulsion system being adapted is powered by an internal combustion engine (not shown) having a cooling system through which a heat-conductive fluid flows. The watercraft has a hull H which, in turn, has a bottom portion B, and a stern portion S. The apparatus of this invention comprises a plate in the form of a heat exchanger 10 having therein a hollow loop 12 connected to the inlet and outlet of the cooling system by a pair of hoses or other hollow tubing 13 (FIGS. 7 and 8 only) extending through hull H and connected in turn, to an inlet nipple 14 and an outlet nipple 16 (seen on FIGS. 2 and 3) for circulating a flow of heat-conductive fluid from the cooling system through loop 12 and thence back to the cooling system. Heat exchanger 10 is pivotally attached to a dual pivot coupling 18 via pivot pins 20. Dual pivot coupling 18, in turn, is pivotally attached to a transom plate 21 at a point proximate to the juncture of stern portion S and bottom portion B via a hinge 22 (FIGS. 1 and 7 only). Transom plate 21, in turn, is fixedly yet detachably attached to stern portion S. It may be seen from FIG. 1 that, during normal operation, hull H is submerged in water up to a water line L which surrounds hull H, and heat exchanger 10 may extend from stern portion S in a substantially horizontal plane which is typically no higher than water line L, and is no lower than bottom portion B. Of course, the actual depth of hull submersion can vary depending upon watercraft design and/or speed. As illustrated in FIG. 2, loop 12 includes a plurality of channels formed by walls 24 which extend through lateral portions of heat exchanger 10, thereby facilitating heat exchange between heat-conductive fluid flowing through heat exchanger 10 and the surrounding water. This configuration provides for a plate in the form of heat exchanger 10 which may be directly or indirectly pivotally attached to stern portion S, while simultaneously providing a hollow heat-conductive loop connected to the engine's cooling system for circulating a flow of heat-conductive fluid from the cooling system through the loop and thence back to the cooling system. Since the loop is also adapted to be disposed in thermally-conductive heat exchange contact with the surrounding water when the watercraft is being propelled by the engine, heat is transferred from the engine in such a way so as to facilitate use of the watercraft in waters which may be shallow or clogged with floating debris. This preferred marine engine cooling apparatus is further described in my copending patent application U.S. Ser. No. 721,224, filed on Sep. 26, 1996 (Case No. S-619 filed contemporaneously herewith).

The engine has a drive shaft 60 which is connected to, and in rotational relationship with, a hollow rotary shaft 62 by joint boot assembly 64. Boot assembly 64 further comprises a universal joint spline 64*a* connected to shaft 60, a constant velocity joint 64*b* which cooperates with rotary shaft 62, an intermediate rotary shaft 64*c* between spline 64*a* and joint 64*b*, two sealing boots 64*d*, and a hollow protective casing 64*e*. Rotary shaft 62, in turn, is connected to, and in rotational relationship with, a reversible pitch propeller 66 (propeller blades not depicted). Thrust bearings 65 and 67 are also provided for transferring propeller thrust to portions of the apparatus surrounding rotary shaft 62.

Figure 4:
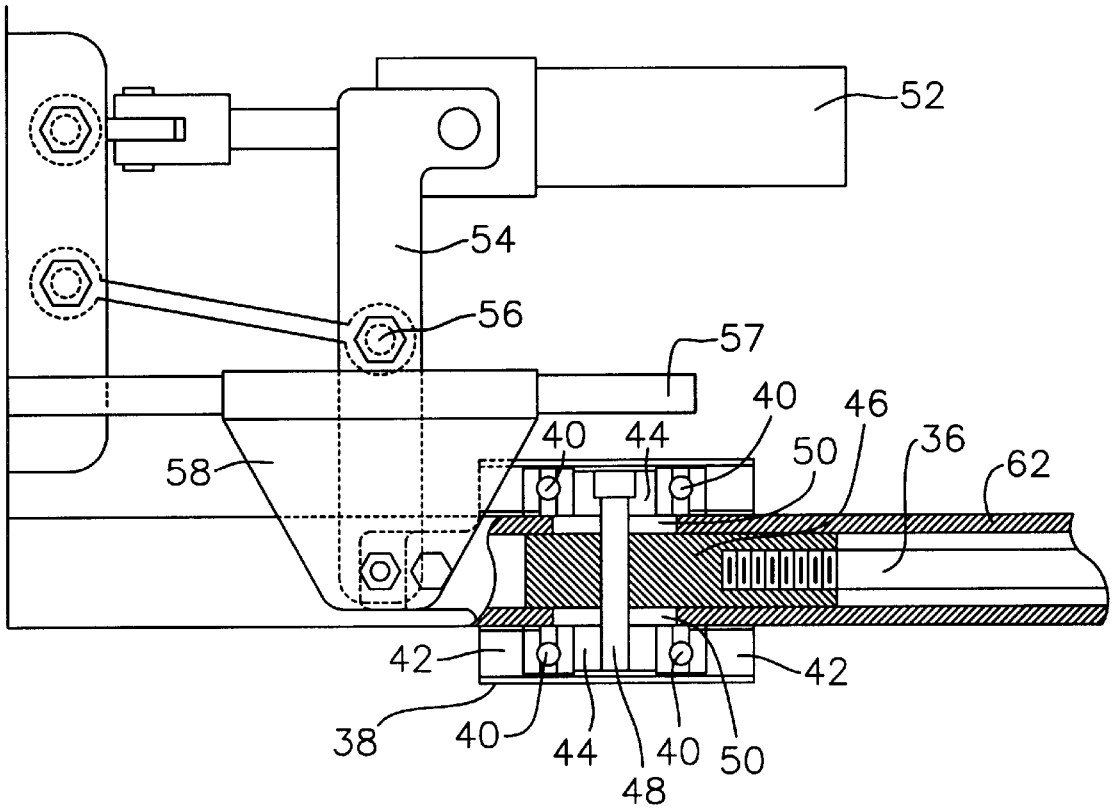
FIG. 4 is an enlarged view of components within broken circle Z illustrated in FIG. 1 showing, among other things, the bearing housing and related components in a neutral position.

The device illustrated also provides adjustment means for adjusting the pitch of the blades of propeller 66. FIGS. 4, 5 and 6 are enlarged views of the area within broken circle Z of FIG. 1, illustrating the range of motion and particular features of the adjustment means. In particular, FIG. 4 shows the adjustment means in a neutral position, while FIGS. 5 and 6 show the adjustment means in a forward and rearward position, respectively. As seen on one or more of FIGS. 1, 4, 5 and 6, the adjustment means includes a pitch-adjusting shaft 34 disposed within rotary shaft 62, shaft 34 having a first end 35 (FIG. 1 only) and a second end 36. Pitch-adjusting shaft 34 is directly or indirectly connected at its first end (FIG. 1 only) to the propeller blades (not shown) in such a way so as to provide blade pitch control via movement of shaft 34 along its own longitudinal axis. A rotary collar-type bearing housing 38 surrounds rotary shaft 62 and contains a plurality of ball bearings 40 a stationary portion 42, and a rotary portion 44, rotary portion 44 being rotatable relative to stationary portion 42 and housing 38. Connecting means for detachably attaching pitch-adjusting shaft 34 to rotary portion 44 is provided in the form of a solid cylindrical slide 46 configured to be detachably attached to second end 36, and a pin 48 which extends through rotary portion 44, through slide 46, and through two elongate apertures 50 in rotary shaft 62 which are opposite one another and extend in parallel fashion along the rotational axis of rotary shaft 62. Hydraulic means are connected to housing 38 for moving housing 38 along the rotational axis of rotary shaft 62. Specifically, these hydraulic means include a hydraulic ram 52 radially disposed from bearing housing 38, an arm 54 rotatably connected to bearing housing 38 and hydraulic ram 52 and having a fulcrum 56, whereby linear force produced by hydraulic ram 52 may be inverted and transferred to bearing housing 38 upon rotation of arm 54 about fulcrum 56. Upon movement of bearing housing 38 along the rotational axis of rotary shaft 62, pitch-adjusting shaft 34 moves along its own longitudinal axis to thereby controllably adjust the pitch of the propeller blades. A true bar 57 (not depicted on FIG. 1) and a glide 58 (not depicted on FIG. 1) connected to arm 54 and housing 38 are also provided to maintain substantially linear movement of housing 38 along the rotational axis of rotary shaft 62 when hydraulic ram 52 is activated. Reversible pitch propeller 66 and the connection between pitch adjusting shaft 34 and the propeller blades are described in greater detail in Applicant's U.S. Pat. Nos. 5,017,090, 5,102,301, and 5,104,291.

Figure 18:
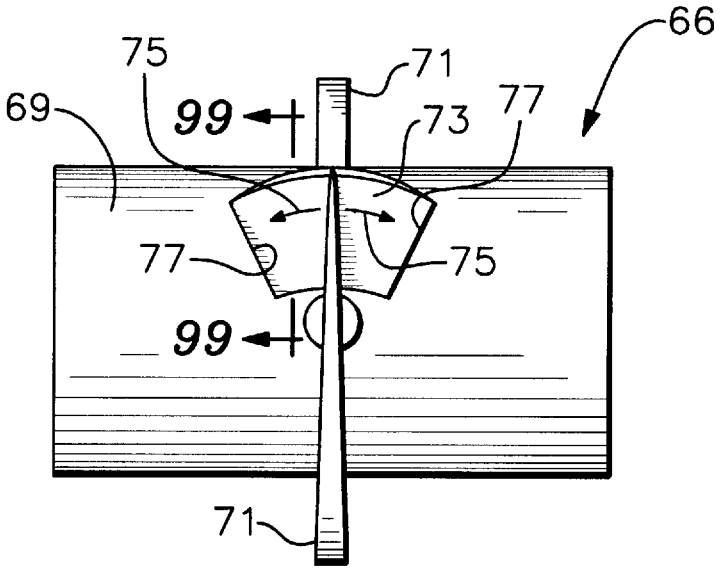
FIG. 18 is a plan view of a preferred propeller component of the device of FIG. 1.
Figure 19:
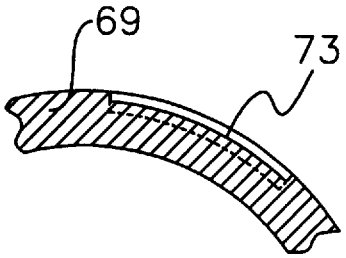
FIG. 19 is a fragmentary section taken along line 29,29 of FIG. 18.

Reference may also be had to the accompanying FIG. 18, which illustrates propeller 66, comprising a hub 69 from which extends a plurality of blades 71 having an adjustable pitch. Hub 69 has a plurality of arcuate grooves 73 (only one shown). To facilitate an understanding of this grooved construction, the arcuate groove 73 in FIG. 18 is depicted as if the groove is in a flat planar surface of hub 69 rather than being cut into the surface of a cylindrical surface of hub 69, which in fact it is. Each arcuate groove 73 is shaped to permit and accommodate rotation of the respective blade 71 in either direction from neutral, as depicted by arrows 75, to the respective ends 77 of the groove. As indicated in FIG. 19, groove 73 becomes deeper when proceeding in the direction of midpoint (i.e., transverse to the axis of hub 69) to the respective ends 77,77. Each arcuate groove cooperates respectively with one of blades 71 so that, notwithstanding a change in pitch, propeller 66 is capable of cutting through and efficiently operating amongst floating vegetation and other fleshy debris suspended in the water.

Rotary shaft 62 is also disposed within a sleeve 68 which is connected to heat exchanger 10. In this way, heat exchanger 10 effectively surrounds rotary shaft 62. By locating heat exchanger 10 at the stern of the watercraft as a component to the propulsion system separate from the hull of the watercraft, the propulsion system is uniquely capable of cooling its own internal combustion engine without requiring hull design modification to integrate the heat exchanger with the hull, and without creating significant watercraft drag. In addition, a fin 63 extends downwardly from the underside of the apparatus and in front of propeller 66. Fin 63 shields propeller 66 from large stationary objects encountered in shallow waters by forcing the apparatus, and therefore propeller 66, upward upon contact with such objects.

As seen in FIG. 2, heat exchanger 10 includes two downwardly disposed ridges or flanges 26 extending from the lateral sides of heat exchanger 10. These flanges extend from the lateral sides at an angle below horizontal, preferably an angle which is between about 30 and 60 degrees. With regard to the distance between the lateral sides of heat exchanger 10, it is preferred that the ratio of propeller diameter (i.e., the diameter of the circle formed by the most radial propeller blade edges during normal propeller rotation) to cavitation plate width (i.e., the distance from the most lateral edge of one flange 26 to the most lateral edge of the other flange 26) is no greater than about 0.75. Flanges 26, in combination with heat exchanger 10, act to direct water toward propeller 66 during operation of the propulsion system and aid in preventing cavitation within the water flow about the propeller blades. In this way, heat exchanger 10 serves the dual purposes of propulsion augmentation through prevention of cavitation, and simultaneous engine coolant heat exchange through contact with the surrounding water. As will be discussed below, when the heat exchanger is also made or supplemented so as to form a substantially contiguous, horizontal undersurface extending from the stern of the watercraft to a point aft of the propeller, the heat exchanger also functions to permit efficient application of significant reverse propeller thrust without the traditional problems of water flow over the stern and into the watercraft.

As noted earlier, pivot pins 20 serve to pivotally attach heat exchanger 10 to dual pivot coupling 18, while coupling 18 is pivotally attached to transom plate 21 by hinge 22. Heat exchanger 10 pivots relative to coupling 18 along a substantially vertical axis, so as to permit lateral movement of heat exchanger 10 relative to hull H. In addition, coupling 18 pivots relative to hull H and transom plate 21 along a substantially horizontal axis, so as to permit vertical movement of heat exchanger 10, rotary shaft 62, and propeller 66. As seen on FIG. 3, these vertical and lateral movements are controlled by a plurality of hydraulic trim and steering rams 70. Coupling 18 in the particular embodiment illustrated is formed by a substantially horizontal base plate 28, two upstanding flanges 30 and a bridge member 32 connecting the top portion of flanges 30.

Figure 8:
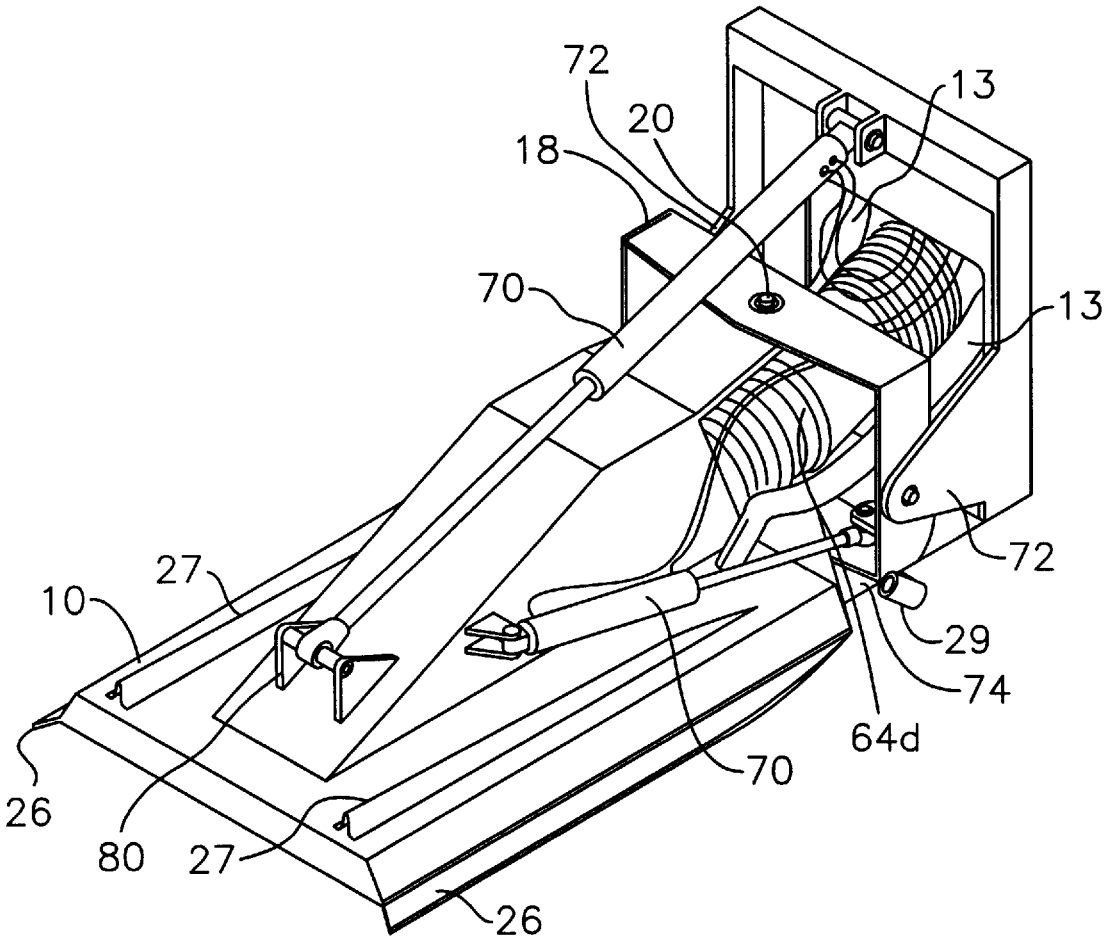
FIG. 8 is a view in perspective of another preferred embodiment of this invention.
Figure 10:
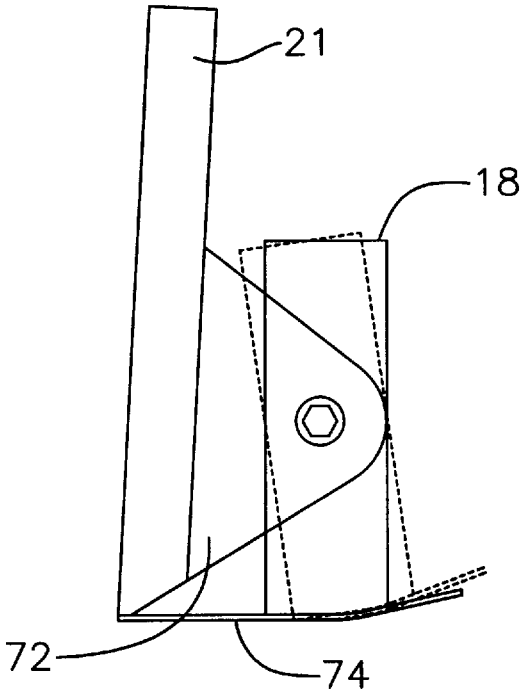
FIG. 10 is a side view with broken lines illustrating relative motion of two component parts of the device of FIG. 8.

FIGS. 8 and 10 illustrate an alternative embodiment of this invention. There, coupling 18 is pivotally attached to transom plate 21 at two pivot arms 72 extending from and integral with transom plate 21. Pivot arms 72 are provided in lieu of hinge 22 found in the other embodiment of FIGS. 1 through 7, while still providing an axis of rotation in a horizontal plane to permit vertical trim of the apparatus. Also illustrated in FIG. 8 is an alternative embodiment wherein only one seal boot 64*d* is employed.

Figure 9:
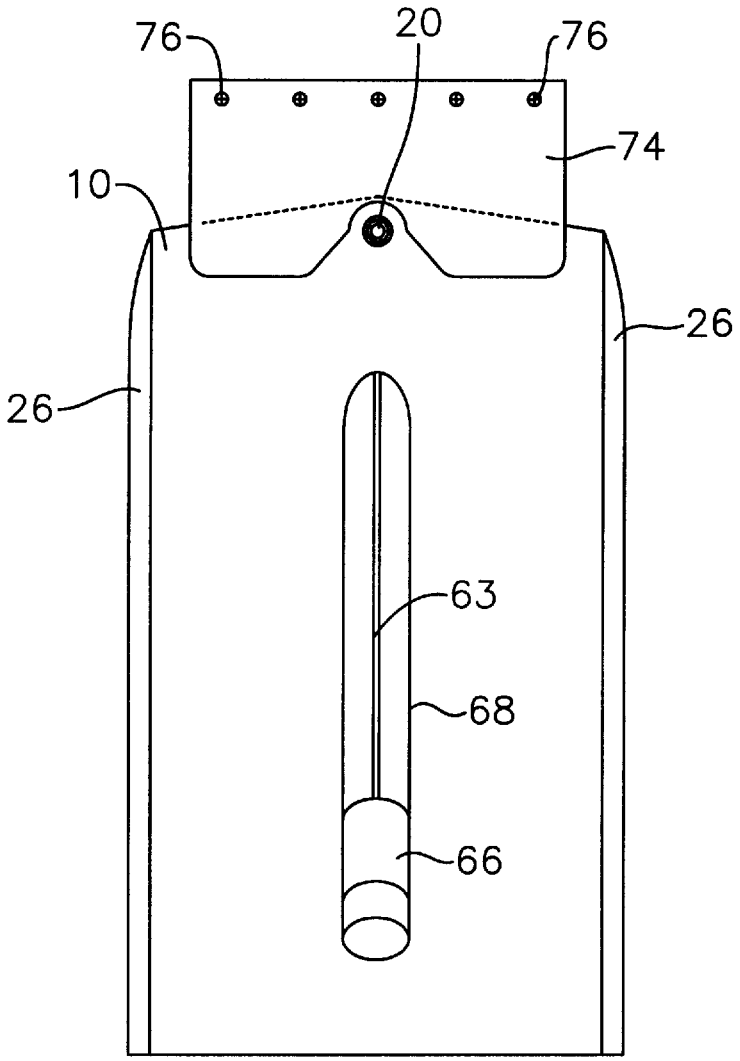
FIG. 9 is a plan view of the underside of the device of FIG. 8.
Figure 11:
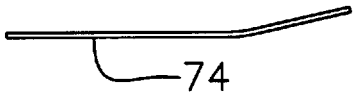
FIG. 11 is a side view of a component part of the device of FIG. 8.

In yet another preferred embodiment illustrated particularly on FIG. 9, the cavitation plate is actually composed of two planar members, heat exchanger 10 serving as the primary planar member, and a supplemental plate 74 serving as a secondary planar member. FIG. 9 shows the planar members in a bottom view of an apparatus of this invention. Plate 74 in this embodiment is a solid plate attached to the bottom of transom plate 21 by a plurality of screws 76, and includes a slight undulation in its form as illustrated by a side view set forth in FIG. 11. This undulation permits vertical trimming of the apparatus at coupling 18, while maintaining a close fit between plate 74 and heat exchanger 10 at all times. In the embodiment illustrated, plate 74 partially overlaps coupling 18 and heat exchanger 10 to prevent forced water from flowing therebetween when the propulsion system is in a reverse thrust setting. FIG. 10 is a side view with broken lines illustrating relative motion of coupling 18 and plate 74 during vertical trimming. In this way, heat exchanger 10 and plate 74 form a substantially contiguous, horizontal undersurface extending from the stern of the watercraft to a point aft of the propeller. Thus, in addition to its other functions, heat exchanger 10 as applied here permits efficient application of significant reverse propeller thrust without the traditional problems of water flow over the stern and into the watercraft; and all of this even at different levels of vertical trim.

Figure 12:
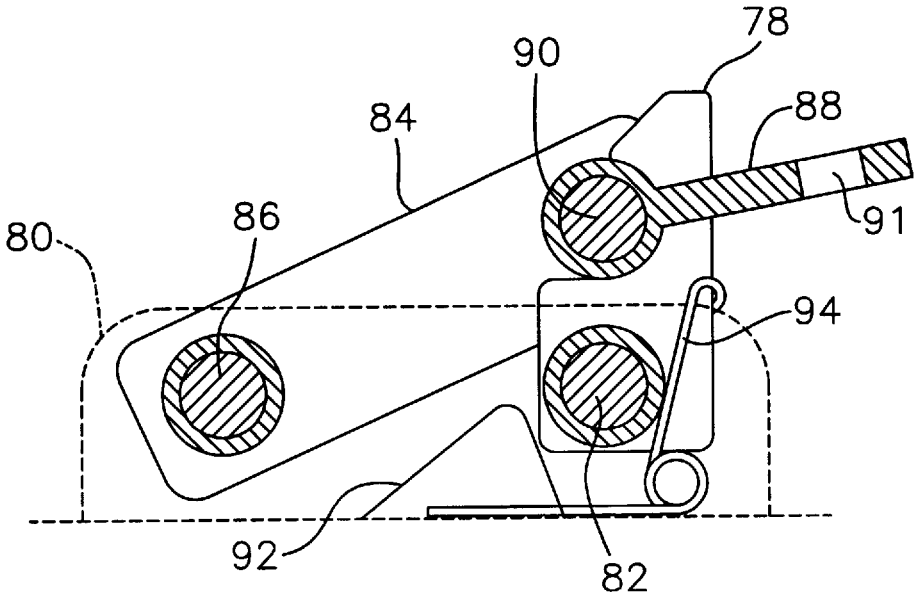
FIG. 12 is a cross-sectional, side view of a preferred release mechanism component of a device of this invention.
Figure 13A:
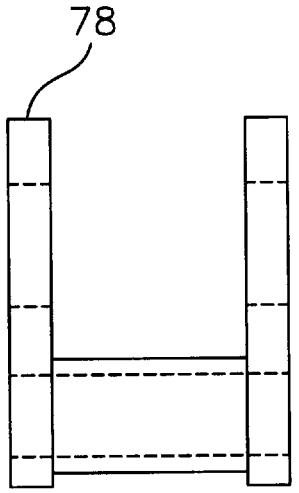
FIG. 13A is a plan view of a component of the mechanism of FIG. 12.
Figure 13B:
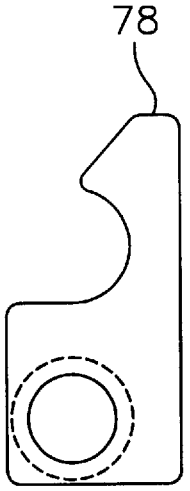
FIG. 13B is a side view of the component of FIG. 13A.
Figure 14A:
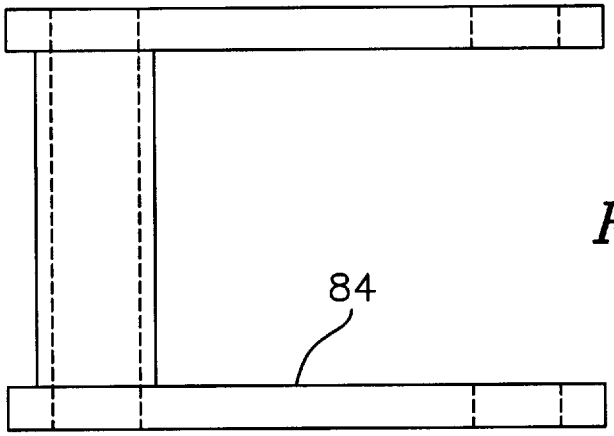
FIG. 14A is a plan view of another component of the mechanism of FIG. 12.
Figure 14B:
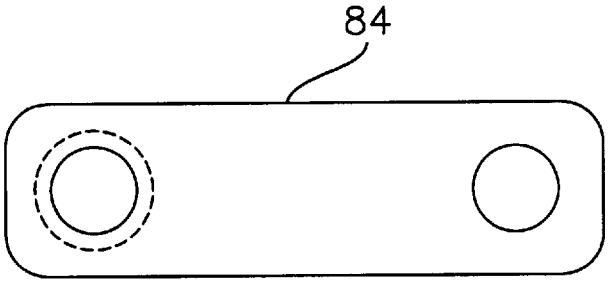
FIG. 14B is a side view of the component of FIG. 14A.
Figure 15A:
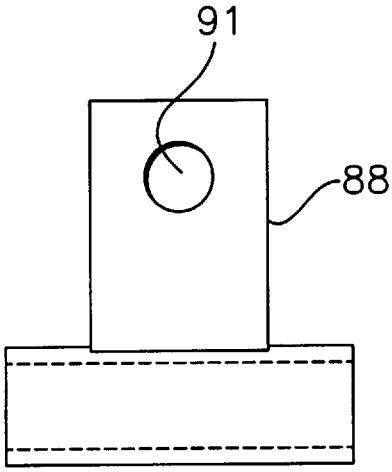
FIG. 15A is a plan view of another component of the mechanism of FIG. 12.
Figure 15B:
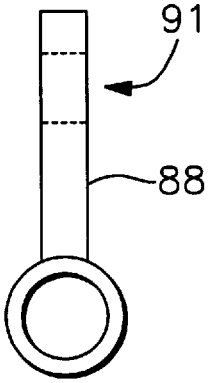
FIG. 15B is a side view of the component of FIG. 15A.

Preferred embodiments of this invention further comprise a release mechanism cooperating with hydraulic steering mechanisms to prevent sudden upward forces from stumps and other solid debris or objects in the surrounding water from damaging those hydraulic steering mechanisms and other important components of the device. FIG. 12 is a cross-sectional side view of a particularly preferred release mechanism in accordance with this invention. The other section of the illustrated mechanism not shown in FIG. 12 is a mirror image of the section depicted. In the section depicted, a dual latch member 78 is pivotally connected to one of two flanges 80 (only one flange shown in FIG. 12; shown with phantom lines) at a joint 82. A U-shaped bar 84 is pivotally attached to flange 80 at a joint 86 and to one end of a solid bar 88 at a joint 90. The other end of solid bar 88 is in turn rigidly connected to the end of hydraulic trim ram 70 (not shown) via an aperture 91. Latch member 78 pivots between one of two stops 92 and one of two springs 94 to hold U-shaped bar 84 and solid bar 88 at joint 90, thereby maintaining bars 84 and 88 and hydraulic trim ram 70 in substantially alignment with one another end to end during normal operation. Springs 94 act to supply sufficient pressure to latch member 78 so as to hold latch member 78 in vertical position. Latch member 78 remains in its substantially vertical position unless a predetermined level of upward force is applied to the apparatus. In such event, the force will cause latch 78 to release U-shaped bar 84 at joint 90, thereby permitting the apparatus to move upward in response to the applied upward force without damaging hydraulic trim ram 70. Upon cessation of this upward force, gravity acts to force the apparatus and joint 90 downward, so that joint 90 opens latch 78 and springs 94 close latch member 78 to hold joint 90 in place again. FIGS. 13A and 13B illustrate top and side plan views, respectively, of latch 78. FIGS. 14A and 14B illustrate top and side plan views, respectively, of bar 84. FIGS. 15A and 15B illustrate top and side views, respectively, of solid bar 88. Obviously, various types of hydraulic pressure releases, springs and other latching mechanisms may be used to perform the same function as the mechanism illustrated here, and all are within the scope of this invention. Such mechanisms may be integral with the hydraulic ram, or may be an additional mechanical device connected to the hydraulic ram, Mechanical release configurations which employ compression springs are preferred on account of their simplicity in design, manufacture, and maintenance.

To increase the cooling capacity of heat exchanger 10, as for example when larger engines are used in conjunction with the apparatus, it is preferred that heat exchanger 10 include one or more cooling fins 27 extending upwardly from the top of heat exchanger 10. To even further improve the cooling capacity of heat exchanger 10, the apparatus preferably includes a water deflector 29 attached, for example, to each flange 30 for deflecting at least a spray of water onto the top surface of heat exchanger 10, thereby further increasing the effectiveness of heat exchanger 10. Of course, deflector 29 may be attached to a variety of different components of the apparatus, so long as the end result is deflection of water onto the top of heat exchanger 10. Thus, as may be seen from FIG. 4, as the apparatus propels the watercraft through water at high speeds, a spray of water is deflected by deflector 29 onto the top of exchanger 10 and the cooling fins 27. These preferred embodiments are particularly effective when the apparatus of this invention is used in conjunction with diesel marine engines and/or engines having about 100 horse power or greater.

Figure 16A:
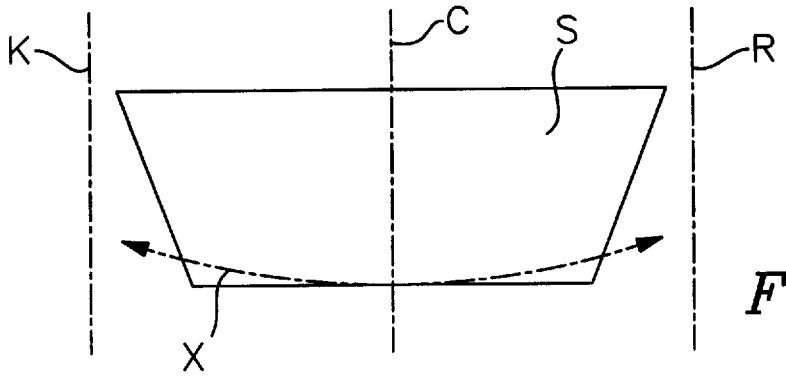
FIG. 16A is a rear view of the transom of a boat illustrating schematically motion of a portion of a preferred embodiment of this invention when used with such a boat.
Figure 16B:
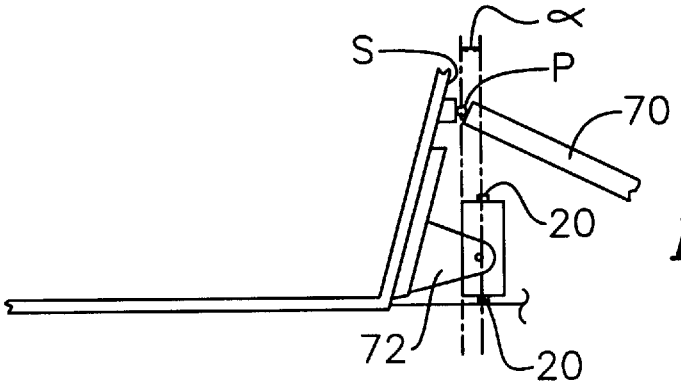
FIG. 16B is a side view partially broken away of a portion of the device of FIG. 16A illustrating schematically the distance between certain portions thereof.
Figure 17A:
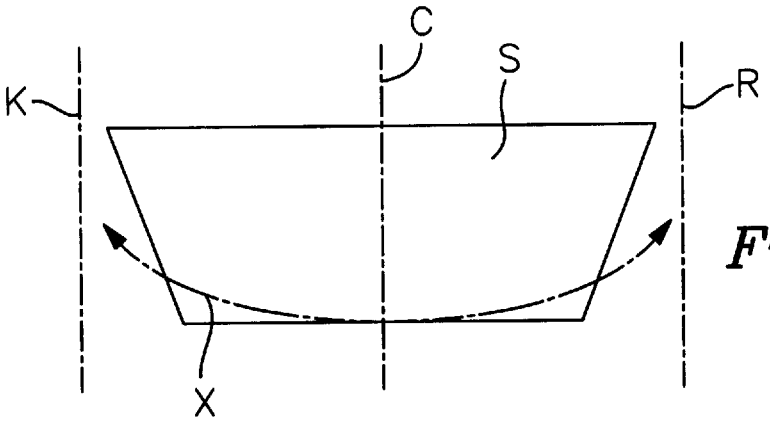
FIG. 17A is a rear view of the transom of a boat illustrating schematically motion of a portion of a preferred embodiment of this invention when used with such a boat.
Figure 17B:
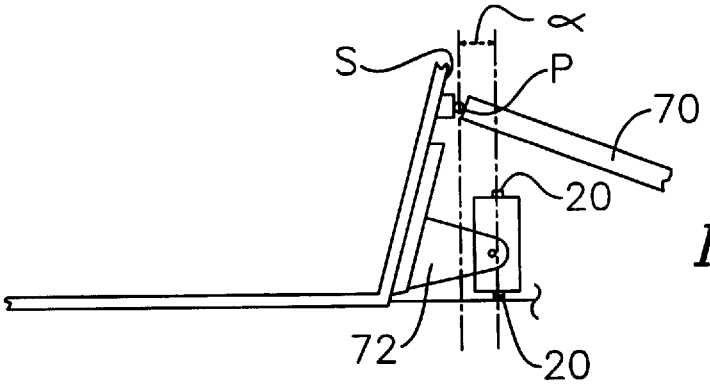
FIG. 17B is a side view partially broken away of a portion of the device of FIG. 17A illustrating schematically the distance between certain portions thereof.

In another preferred embodiment of this invention, the propulsion apparatus and vertical trim mechanism are connected to the stern portion of the watercraft in such a way that, upon lateral movement of the rear side of the apparatus, upward vertical trim occurs automatically and in relation to the degree of lateral movement. This automatic vertical trim permits the apparatus and watercraft to make sharper turns since the rear side of the propulsion apparatus trims upward during left or right turns. This effect is illustrated with reference to FIG. 16A, showing that, as the rear side of the apparatus approaches either line K or line R laterally disposed from watercraft center line C, the vertical position of the rear side changes in an increasing upward direction along a line of motion X. The curvature of line X increases as the distance between (i) a vertical axis through a locus P of connection between the stern portion S and the vertical trim ram 70, and (ii) a vertical axis through pivot pins 20, increases. This distance, $\alpha$, is illustrated in FIG. 16B. FIGS. 17A and 17B illustrate this relationship between $\alpha$ and the curvature of line X, when $\alpha$ is increased from that illustrated in FIG. 16B. In this way, the steering or trim mechanism of the apparatus provides automatic trim during turning to shorten the watercraft turning radius and enhance maneuverability.

It should be noted that a variety of fluids may serve as the heat-conductive fluid utilized to cool the engine portion of the propulsion system of this invention, ranging in type from fresh water to conventional commercially available synthetic compositions and engine coolants. It also should be understood that the plate of this invention may be fabricated from a variety of heat-conductive materials, but is preferably fabricated from a heat-conductive metal. Suitable heat-conductive metals include, for example, stainless steel, aluminum, aluminum alloys, or the like. Most preferably, the heat conductive metal used is an aluminum alloy. The other parts of this invention described herein may be constructed of any of a variety of corrosion-resistant composite materials, metals or metal alloys, with stainless steel, aluminum or aluminum alloys being preferred. Additionally, it will be understood that the loop which extends through the plate of this invention may include one or more channels or pathways through which heat-conductive fluid may flow. The particular configuration of the loop is not a limitation of this invention, provided that the chosen configuration does not impair the heat-conductive function of the heat exchanger.

One of ordinary skill in the art will understand that the adjustment means of this invention may comprise a wide variety of mechanical, electrical, and/or hydraulic devices which accomplish the efficient adjustment of propeller pitch on a reversible pitch propeller. Likewise, the trim and steering mechanisms of this invention may comprise a wide variety of mechanical, electrical, and/or hydraulic devices which accomplish the efficient, controlled lateral and vertical movement of the device in order to control the direction of thrust produced by the apparatus and propeller. However, in both cases, hydraulic mechanisms similar to that described herein are preferred. It also will be appreciated by those skilled in the art that the particular watercraft hull of this invention may be one of a variety of hulls, including, for example, v-shaped hulls, flat-bottom hulls, pontoons, and catamarans. In the preferred embodiment depicted, the hull is a flat-bottom hull, but it will be understood that this does not constitute a limitation upon this invention, so long as the particular hull chosen functions properly in combination with the propulsion system or apparatus of this invention. Also, a variety of different mechanical configurations may be used at the interface between the drive shaft and the rotary shaft in the devices of this invention. For example, gear boxes, constant velocity joints, and universal joints are only examples of numerous conceivable mechanisms which could be employed to transfer engine power to the rotary shaft. Accordingly, the particular configuration illustrated with detail herein should not be construed as a limitation of the invention.

It will be understood that the device of this invention, and/or each of its individual parts, may have numerous different dimensions, depending upon the requirements of a given set of circumstances, so long as the dimensions do not substantially detract from the function and utility of the device.

The entire disclosure of each and every U.S. patent or patent application, and of each other publication of any kind, referred to in any portion of this specification is incorporated herein by reference.

This invention is susceptible to considerable variation in its practice. Therefore the foregoing description is not intended to limit, and should not be construed as limiting, the invention to the particular forms of the invention described with reference to the drawings. Rather, what is intended to be covered is as set forth in the ensuing claims and the equivalents thereof permitted as a matter of law. In the claims, means-plus-function clauses are intended to cover the structures described herein as performing the cited function and not only structural equivalents but also equivalent structures.

What is claimed is:

1. Apparatus for rendering a watercraft propulsion system universal, said propulsion system being powered by an internal combustion engine having a cooling system through which a heat-conductive fluid flows, said apparatus comprising a) a rotary shaft;

b) a propeller detachably attached to one end of said rotary shaft, the other end of said rotary shaft being configured for detachable and either direct or indirect connection to, and rotational relationship with, a drive shaft of said engine;

c) a plate which is directly or indirectly pivotally attached to a stern portion of said watercraft and which, during normal operation, is disposed in a substantially horizontal plane above said propeller, the plane of said plate traversing said rotary shaft; and d) a hollow heat-conductive loop integral with or connected to said apparatus and connected to said cooling system for circulating a flow of said fluid from said cooling system through said loop and thence back to said cooling system, said loop being adapted to be disposed in thermally-conductive heat exchange contact with said water when said watercraft is being propelled by said engine.

2. Apparatus according to claim 1 further comprising a front side remote from said propeller and a rear side closer to said propeller than said front side, and wherein said loop is disposed within said plate, said plate is disposed in a plane substantially parallel with, but no lower than, the bottom of said watercraft, and said apparatus is detachably and pivotally attached to said stern portion at said front side and is adapted to permit vertical and lateral control of said rear side and said propeller by an operator of said watercraft.

3. Apparatus according to claim 2 wherein a) said propeller further comprises a hub from which extends a plurality of blades having an adjustable pitch, said hub having a plurality of arcuate grooves, each of said grooves cooperating respectively with one of said blades so that, notwithstanding a change in said pitch, said propeller is capable of cutting through and efficiently operating amongst floating vegetation and other fleshy debris suspended in said water; and b) said apparatus further comprises adjustment means for controllably adjusting said pitch.

4. Apparatus according to claim 3 wherein said adjustment means comprises a pitch-adjusting shaft detachably and either directly or indirectly connected to said blades at one end, and at least one position-shifting mechanism directly or indirectly connected to the other end of said pitch-adjusting shaft for axially moving said pitch-adjusting shaft and thereby controllably reversing said pitch.

5. Apparatus according to claim 4 wherein said plate and said loop are composed of a heat-conductive metal.

6. Apparatus according to claim 2 further comprising at least one hydraulic trim ram connecting an upper portion of said apparatus to said stern portion, for controlling the position of said rear side and said propeller.

7. Apparatus according to claim 2 further comprising at least one hydraulic steering ram connecting a lateral side of said apparatus to said stern portion, for controlling the position of said rear side and said propeller.

8. Apparatus according to claim 2 wherein said apparatus is detachably and pivotally attached to said stern portion at said front side by a dual pivot coupling, said coupling being pivotally attached to said apparatus and said watercraft so as to permit lateral and vertical movement of said rear side and said propeller relative to said stern portion of said watercraft.

9. Apparatus according to claim 2 wherein said plate and said loop are composed of a heat-conductive metal.

10. Apparatus according to claim 2 further comprising (i) at least one trim mechanism connecting an upper portion of said apparatus to said stern portion, for controlling the vertical position of said rear side and said propeller, and (ii) at least one steering mechanism connecting a lateral side of said apparatus to said stern portion, for controlling the lateral position of said rear side and said propeller.

11. Apparatus according to claim 10 wherein said trim mechanism is a hydraulic ram, said steering mechanism is a hydraulic steering ram, and said apparatus is detachably and pivotally attached to said stern portion at said front side by a dual pivot coupling, said coupling being pivotally attached to said apparatus and said watercraft so as to permit lateral and vertical movement of said rear side and said propeller relative to said stern portion of said watercraft.

12. Apparatus according to claim 2 wherein said plate extends laterally beyond the lateral ends of said propeller and longitudinally from said stern portion to beyond the rear of said propeller, said plate having at each of its lateral sides a downwardly projecting flange extending along a substantial portion of said plate fore and aft of said propeller.

13. Universal propulsion apparatus for propelling a watercraft, said apparatus comprising a) a power portion which comprises an internal combustion engine attached to said watercraft, said engine having a cooling system through which a heat-conductive fluid flows;

b) a drive portion which comprises:

1) a rotary shaft;

2) a propeller detachably attached to one end of said rotary shaft, the other end of said rotary shaft being configured for detachable and either direct or indirect connection to, and rotational relationship with, a drive shaft of said engine;

3) a plate which, during normal operation, is disposed in a substantially horizontal plane above said propeller, the plane of said plate traversing said rotary shaft;

4) a hollow heat-conductive loop integral with or connected to said drive portion and connected to said cooling system for circulating a flow of said fluid from said cooling system through said loop and thence back to said cooling system, said loop being adapted to be disposed in thermally-conductive heat exchange contact with said water when said watercraft is being propelled by said engine; and 5) a front side remote from said propeller and a rear side closer to said propeller than said front side;

said drive portion being detachably and pivotally attached to a stern portion of said watercraft at said front side of said drive portion and adapted to permit vertical and lateral control of said rear side of said drive portion by an operator of said watercraft.

14. Propulsion apparatus according to claim 13 wherein said loop is disposed within said plate, and said plate is disposed in a plane substantially parallel with, but no lower than, the bottom of said watercraft.

15. Propulsion apparatus according to claim 14 wherein a) said propeller further comprises a hub from which extends a plurality of blades having an adjustable pitch, said hub having a plurality of arcuate grooves, each of said grooves cooperating respectively with one of said blades so that, notwithstanding a change in said pitch, said propeller is capable of cutting through and efficiently operating amongst floating vegetation and other fleshy debris suspended in said water; and b) said apparatus further comprises adjustment means for controllably adjusting said pitch.

16. Propulsion apparatus according to claim 15 wherein said adjustment means comprises a pitch-adjusting shaft detachably and either directly or indirectly connected to said blades at one end, and at least hydraulic mechanism directly or indirectly connected to the other end of said pitch-adjusting shaft for axially moving said pitch-adjusting shaft and thereby controllably reversing said pitch.

17. Propulsion apparatus according to claim 16 wherein said plate and said loop are composed of a heat-conductive metal.

18. Propulsion apparatus according to claim 13 further comprising at least one hydraulic trim ram connecting an upper portion of said apparatus to said stern portion, for providing control of the vertical position of said rear side and said propeller.

19. Propulsion apparatus according to claim 13 further comprising at least one hydraulic steering ram connecting a lateral side of said apparatus to said stern portion, for providing control of the lateral position of said rear side and said propeller.

20. Propulsion apparatus according to claim 13 wherein said apparatus is detachably and pivotally attached to said stern portion at said front side by a dual pivot coupling, said coupling being pivotally attached to said apparatus and said watercraft so as to permit lateral and vertical movement of said rear side and said propeller relative to said stern portion of said watercraft.

21. Propulsion apparatus according to claim 13 wherein said plate and said loop are composed of a heat-conductive metal.

22. Propulsion apparatus according to claim 13 further comprising (i) at least one hydraulic trim ram connecting an upper portion of said apparatus to said stern portion, for controlling the vertical position of said rear side and said propeller, and (ii) at least one hydraulic steering ram connecting a lateral side of said apparatus to said stern portion, for controlling the lateral position of said rear side and said propeller.

23. Propulsion apparatus according to claim 22 wherein said apparatus is detachably and pivotally attached to said stern portion at said front side by a dual pivot coupling, said coupling being pivotally attached to said apparatus and said watercraft so as to permit lateral and vertical movement of said rear side and said propeller relative to said stern portion of said watercraft.

24. Propulsion apparatus according to claim 13 wherein said plate extends laterally beyond the lateral ends of said propeller and longitudinally from said stern portion to beyond the rear of said propeller, said plate having at each of its lateral sides a downwardly projecting flange extending along a substantial portion of said plate fore and aft of said propeller.

25. Universal watercraft apparatus, said watercraft comprising a boat hull and a propulsion drive apparatus connected thereto, said propulsion drive apparatus comprising a) a power portion which comprises an internal combustion engine attached to said boat hull, said engine having a cooling system through which a heat-conductive fluid flows;

b) a drive portion which comprises:

1) a rotary shaft;

2) a propeller detachably attached to one end of said rotary shaft, the other end of said rotary shaft being configured for detachable and either direct or indirect connection to, and rotational relationship with, a drive shaft of said engine;

3) a plate which, during normal operation, is disposed in a substantially horizontal plane above said propeller, the plane of said plate traversing said rotary shaft; and 4) a hollow heat-conductive loop integral with or connected to said drive portion and connected to said coolng system for circulating a flow of said fluid from said cooling system through said loop and thence back to said cooling system, said loop being adapted to be disposed in thermally-conductive heat exchange contact with said water when said watercraft apparatus is being propelled by said engine; and 5) a front side remote from said propeller and a rear side closer to said propeller than said front side;

said drive portion being detachably and pivotally attached to a stem portion of said boat hull at said front side of said drive portion and adapted to permit vertical and lateral control of said rear side of said drive portion by an operator of said watercraft apparatus.

26. Watercraft apparatus according to claim 25 wherein said loop is disposed within said plate, and said plate is disposed in a plane substantially parallel with, but no lower than, the bottom of said boat hull.

27. Watercraft apparatus according to claim 25 wherein said plate extends laterally beyond the lateral ends of said propeller and longitudinally from said stern portion of said watercraft to beyond the rear of said propeller, said plate having at each of its lateral sides a downwardly projecting flange extending along a substantial portion of said plate fore and aft of said propeller.

28. A method of universally propelling a watercraft, said method comprising equipping said watercraft with apparatus in accordance with any one of claims 13 through 24, and operating said apparatus to provide controllable thrust to said watercraft.

29. Apparatus for controllably adjusting the pitch of propeller blades on an adjustable pitch propeller, said propeller being attached to a hollow rotary shaft, said apparatus comprising:

a) a pitch-adjusting shaft disposed within said rotary shaft and having a first end and a second end, said pitch-adjusting shaft being directly or indirectly connected at said first end to said propeller blades;

b) a bearing housing surrounding said rotary shaft and containing a stationary portion and a rotary portion, said rotary portion being rotatable relative to said stationary portion and said housing;

c) at least one connector for detachably attaching said pitch-adjusting shaft to said rotary portion; and d) at least one hydraulic position-shifting mechanism connected to said bearing housing for moving said bearing housing along the rotational axis of said rotary shaft;

whereby, upon movement of said bearing housing along the rotational axis of said rotary shaft, said pitch-adjusting shaft moves along its own longitudinal axis to thereby controllably adjust the pitch of said propeller blades.

30. Apparatus according to claim 29, wherein said connector comprises (i) a cylindrical slide configured to be detachably attached to said second end opposite said propeller, and (ii) a pin which extends through said rotary portion, through said cylindrical slide, and through two elongate apertures in said rotary shaft which are opposite one another and extend in parallel fashion along the rotational axis of said rotary shaft.

31. Apparatus according to claim 29 wherein said hydraulic mechanism comprises a hydraulic ram radially disposed from said bearing housing, an arm rotatably connected to said bearing housing and said hydraulic ram and having a fulcrum, whereby linear force produced by said hydraulic ram may be inverted and transferred to said bearing housing upon rotation of said arm about said fulcrum.

32. Universal propulsion apparatus for propelling a watercraft, said apparatus comprising a) a power portion which comprises an internal combustion engine attached to said watercraft; and b) a drive portion which comprises:

1) a rotary shaft;

2) a propeller detachably attached to one end of said rotary shaft, the other end of said rotary shaft being configured for detachable and either direct or indirect connection to, and rotational relationship with, a drive shaft of said engine;

3) a cavitation plate which, during normal operations, is disposed in a substantially horizontal plane above said propeller and around said rotary shaft;

4) a supplemental plate extending between said cavitation plate and the transom of said watercraft in a substantially horizontal plane at or near the bottom of said watercraft; and 5) a front side remote from said propeller and a rear side closer to said propeller than said front side;

said drive portion being detachably and pivotally attached to a stern portion of said watercraft at said front side of said drive portion and adapted to permit vertical and lateral control of said rear side of said drive portion by an operator of said watercraft.

33. Propulsion apparatus according to claim 32 wherein said plate extends laterally beyond the lateral ends of said propeller and longitudinally from said stern portion of said watercraft to beyond the rear of said propeller, said plate having at each of its lateral sides a downwardly projecting flange extending along a substantial portion of said plate fore and aft of said propeller.

34. Propulsion apparatus according to claim 32 further comprising at least one hydraulic trim ram connecting an upper portion of said apparatus to said stern portion of said watercraft, thereby enabling control of the vertical position of said rear side, and further comprising a release mechanism connected to or integral with said trim ram which is activated upon application of a predetermined level of upward force to said propulsion apparatus.

35. Propulsion apparatus according to claim 34 wherein said release mechanism comprises a bar pivotally connected to said trim ram at a joint, and one or more spring-loaded latches connected to said apparatus and cooperating with said joint to hold said trim ram in place during normal operation unless said predetermined level of upward force is applied to said propulsion apparatus.

36. Propulsion apparatus according to claim 32 wherein a) said propeller further comprises a hub from which extends a plurality of blades having an adjustable pitch, said hub having a plurality of arcuate grooves, each of said grooves cooperating respectively with one of said blades so that, notwithstanding a change in said pitch, said propeller is capable of cutting through and efficiently operating amongst floating vegetation and other fleshy debris suspended in said water; and b) said apparatus further comprises adjustment means for controllably adjusting said pitch.

37. Propulsion apparatus according to claim 36 wherein said adjustment means comprises a pitch-adjusting shaft detachably and either directly or indirectly connected to said blades at one end, and at least one hydraulic mechanism directly or indirectly connected to the other end of said pitch-adjusting shaft for axially moving said pitch-adjusting shaft and thereby controllably reversing said pitch.

38. Propulsion apparatus according to claim 37 wherein said plate extends laterally beyond the lateral ends of said propeller and longitudinally from said stern portion of said watercraft to beyond the rear of said propeller, said plate having at each of its lateral sides a downwardly projecting flange extending along a substantial portion of said plate fore and aft of said propeller.

39. Propulsion apparatus according to claim 38 further comprising at least one hydraulic trim ram connecting an upper portion of said apparatus to said stern portion of said watercraft, thereby enabling control of the vertical position of said rear side, and further comprising a release mechanism connected to or integral with said trim ram which is activated upon application of a predetermined level of upward force to said propulsion apparatus.

40. Propulsion apparatus according to claim 39 wherein said release mechanism comprises a bar pivotally connected to said trim ram at a joint, and one or more spring-loaded latches connected to said apparatus and cooperating with said joint to hold said trim ram in place during normal operation unless said predetermined level of upward force is applied to said propulsion apparatus.

41. A watercraft propulsion system which comprises a reversible pitch propeller and a cavitation plate disposed above said propeller, said cavitation plate extending laterally beyond the lateral ends of said propeller and longitudinally from a stern portion of the watercraft to beyond the rear of said propeller, said plate having at each of its lateral sides a downwardly projecting flange extending along a substantial portion of said plate fore and aft of said propeller and said plate forming a substantially contiguous, horizontal undersurface extending from the stern of the watercraft to a point aft of the propeller.

42. A watercraft propulsion system according to claim 41, wherein said cavitation plate comprises at least two partially overlapping planar members.

43. A watercraft propulsion system according to claim 41, wherein the ratio of propeller diameter to cavitation plate width is no greater than about 0.75.

44. A watercraft propulsion system according to claim 41, wherein said flange projects downwardly at an angle of between 30° and 60° below horizontal.

45. A watercraft propulsion system according to claim 44, wherein said cavitation plate comprises at least two partially overlapping planar members.

46. A watercraft propulsion system according to claim 45, wherein the ratio of propeller diameter to cavitation plate width is no greater than about 0.75.

* * * * *

UNITED STATES PATENT AND TRADEMARK OFFICE

CERTIFICATE OF CORRECTION

PATENT NO. : 5,863,230

DATED : January 26, 1999

INVENTOR(S) : Douglas M. Morrison

It is certified that error appears in the above-identified patent and that said Letters Patent is hereby corrected as shown below:

Claim 25, Column 15, line 44, reads "stem" but should read --stern--.

Signed and Sealed this

Thirteenth Day of July, 1999

*Attest:*

*Attesting Officer*

Q. TODD DICKINSON

*Acting Commissioner of Patents and Trademarks*